US007375297B2

(12) United States Patent
Yurochko et al.

(10) Patent No.: US 7,375,297 B2
(45) **Date of Patent: *May 20, 2008**

(54) METHOD AND APPARATUS TO IMPROVE TACTILE FEEL FOR KEYBOARDS AND BUTTON ASSEMBLIES

(75) Inventors: Michael A. Yurochko, Los Gatos, CA (US); Peter N. Skillman, San Carlos, CA (US)

(73) Assignee: Palm, Inc., Sunnyvale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/561,865

(22) Filed: Nov. 20, 2006

(65) Prior Publication Data

US 2007/0151832 A1 Jul. 5, 2007

Related U.S. Application Data

(63) Continuation of application No. 10/772,110, filed on Feb. 3, 2004, now Pat. No. 7,164,088.

(60) Provisional application No. 60/479,392, filed on Jun. 17, 2003, provisional application No. 60/455,178, filed on Mar. 16, 2003.

(51) Int. Cl.
*H01H 9/00* (2006.01)

(52) U.S. Cl. ..... 200/5 A; 200/4; 200/512; 400/472

(58) Field of Classification Search ..... 200/5 A, 200/4, 1 R, 512, 341–345; 400/472, 490–495
See application file for complete search history.

(56) References Cited

U.S. PATENT DOCUMENTS

| | | | | |
|---|---|---|---|---|
| 4,279,021 | A | 7/1981 | See et al. | |
| 4,415,065 | A | 11/1983 | Sandstedt | |
| 4,587,630 | A | 5/1986 | Straton et al. | |
| 4,725,694 | A | 2/1988 | Auer et al. | |
| 4,887,212 | A | 12/1989 | Zamora et al. | |
| 4,892,981 | A * | 1/1990 | Soloway et al. | 200/5 A |
| 4,916,441 | A | 4/1990 | Gombrich | |
| D320,598 | S | 10/1991 | Auerbach et al. | |

(Continued)

FOREIGN PATENT DOCUMENTS

EP 01/49762 7/1986

OTHER PUBLICATIONS

"3GPP2 Multimedia Messaging System—MMS Specification Overview—Revision: A" [online], May 2003, Mobile Messaging, [retrieved on Dec. 10, 2004]. Retrieved from the Internet: <url:http://www.lebodic.net/left.htm.

(Continued)

*Primary Examiner*—K. Richard Lee
(74) *Attorney, Agent, or Firm*—Shemwell Mahamedi LLP

(57) ABSTRACT

A keyboard for an electronic device that incorporates a flexible carrier for the keys. The flexible carrier has cutouts or slots that aid in decoupling the actions of one from its neighbors. Moreover, in addition to or instead of cutouts or slots, the flexible carrier optionally has cutouts around its outer perimeter. In some embodiments, the keys are molded as part of the flexible carrier. In other embodiments, the keys are attached to or inserted in the flexible carrier during manufacture. Various embodiments of the invention employ various key shapes to aid the user's tactile experience while typing.

24 Claims, 21 Drawing Sheets

U.S. PATENT DOCUMENTS

| | | | | |
|---|---|---|---|---|
| 5,067,164 | A | 11/1991 | Denker et al. | |
| 5,101,439 | A | 3/1992 | Kiang | |
| 5,218,188 | A | 6/1993 | Hanson | |
| 5,227,614 | A | 7/1993 | Danielson et al. | |
| 5,334,824 | A | 8/1994 | Martinez | |
| 5,335,276 | A | 8/1994 | Thompson et al. | |
| 5,336,001 | A | 8/1994 | Lichtenberg | |
| 5,345,615 | A | 9/1994 | Garofalo | |
| 5,357,065 | A * | 10/1994 | Mitamura et al. | 200/5 A |
| 5,359,317 | A | 10/1994 | Gomez et al. | |
| 5,379,057 | A | 1/1995 | Clough et al. | |
| 5,392,447 | A | 2/1995 | Schlack et al. | |
| D359,920 | S | 7/1995 | Sakamoto | |
| 5,465,401 | A | 11/1995 | Thompson | |
| 5,503,484 | A | 4/1996 | Louis | |
| 5,705,995 | A | 1/1998 | Laflin et al. | |
| 5,742,894 | A | 4/1998 | Jambhekar et al. | |
| 5,812,651 | A | 9/1998 | Kaplan | |
| 5,917,906 | A | 6/1999 | Thornton | |
| 5,941,648 | A | 8/1999 | Robinson et al. | |
| D416,256 | S | 11/1999 | Griffin et al. | |
| 6,058,304 | A | 5/2000 | Callaghan et al. | |
| 6,101,531 | A | 8/2000 | Eggleston et al. | |
| 6,166,342 | A * | 12/2000 | Chou | 200/344 |
| 6,198,053 | B1 * | 3/2001 | Chou | 200/5 A |
| 6,256,631 | B1 | 7/2001 | Macolm | |
| 6,295,372 | B1 | 9/2001 | Hawkins et al. | |
| 6,310,609 | B1 | 10/2001 | Morgenthaler | |
| D454,349 | S | 3/2002 | Makidera et al. | |
| 6,370,018 | B1 | 4/2002 | Miller et al. | |
| D456,794 | S | 5/2002 | Laverick et al. | |
| 6,415,138 | B2 | 7/2002 | Sirola et al. | |
| D462,354 | S | 9/2002 | Kimbre et al. | |
| 6,452,588 | B2 | 9/2002 | Griffin et al. | |
| D464,962 | S | 10/2002 | MacGregor et al. | |
| D468,714 | S | 1/2003 | Maruska et al. | |
| D470,842 | S | 2/2003 | Bhatia et al. | |
| D471,559 | S | 3/2003 | De Saulles | |
| D477,597 | S | 7/2003 | Laverick et al. | |
| D488,478 | S | 4/2004 | Laverick et al. | |
| 2002/0044136 | A1 | 4/2002 | Griffin et al. | |

OTHER PUBLICATIONS

"American Programmer," N.Y., American Programmer, Inc. (Dec. 1991), pp. 4-33.

"An Introduction to Mobile Messaging" [online], May 2003, Mobile Messaging, [retrieved on Dec. 10, 2004]. Retrieved from the Internet: <url:http://www.lebodic.net/intro.htm>.

"At Last, Technology Harnesse[sic] One of the Most Powerf[sic] Forces Known to Man," Foster City, GO Corporation, 1991, 14 pages.

"IBM Selects Racotek Data/Voice Communications Services to Interface With Touchmobile Product," PR Newswire, Jan. 25, 1993, 2 pages.

"IBM Touchmobile Information and Planning Guide," IBM, Inc., Mar. 1993, 20 pages.

"IBM Touchmobile Solution for Data Capture and Communication, Keeping Your Business Moving in the 90s," IBM, Inc., Jan. 1993, 13 pages.

"IBM's Touchmobile Helps Field Workers Collect Data at the Touch of a Finger," PR Newswire, Jan. 26, 1993, 2 pages.

"Nokia Introduces Mobile Chat With Nokia 3310," [online], Sep. 1, 2000, [retrieved on Nov. 17, 2003]. <http://www.mmobiletechnews.com/info/2000/09/01/142022.htm>.

AT&T News Release, "NCR Cuts Price of 3170 Notebook Computer 11 to 19 Percent" [online]. Mar. 8, 1993, Retrieved from the Internet: <url:http://www.att.com/press/0393/930308.nca.html> 2 pages.

Carr, R.M., "The Point of the Pen" Byte, Feb. 1991, Reprinted, 10 pages.

Cullen, A., "A Lookup Guide to the EO Personal Communicator," Mountain View, EO, Inc., 1992, 1993, pp. ii-320.

Cullen, A., "Connecting With Your EO Personal Communicator," Mountain View, EO, Inc., 1992, 1993, pp. ii-33.

Cullen, A., "Getting Started With Your EP Personal Communicator," Mountain View, EO, Inc., 1992, 1993, pp. ii-74.

Go Corporation Information Statement, Nov. 8, 1993, 114 pages.

Hewlett Packard, Products and services, <http://www.hp.com> Nov. 11, 2001.

MacNeill, D., "Messaging Card and NewtonMail: We Pick Up and Deliver," On the Go Magazine [online], Oct. 13, 1993, Retrieved from the Internet <url:http://www.pencomputing.com/Newton/NewtonNotes2.html> 2 pages.

Macneill, D., "Wireless Newton Technology Goes to Work," On The Go Magazine [online], Sep. 8, 1993, Retrieved from the Internet: <url:http://www.pencomputing.com/Newton/NewtonNotes1.html> 2 pages.

Maki, K., "The AT&T EO Travel Guide," N.Y., John Wiley & Sons, Inc., 1993, pp. 11-555.

Nokia, Frequently Asked Questions; [online], [retrieved on Nov. 17, 2003]. <http://www.nokia.co.in/nokia_apac/india/faqs_list/0.18778.39_41,00.html>.

Schlendere, R.R., "Hot New PCs That Read Your Writing," Fortune, Feb. 11, 1991, Reprinted, 6 pages.

Stock, R., "The World of Messagint An Introduction to Personal Communications," Mountain View, EO, Inc., 1992, 1993, pp. ii-69.

T-Mobile Products: Handhelds <http://www.tmobile.com> Sep. 28, 2002.

T-Mobile Products: Sidekick <http://www.tmobile.com> Sep. 28, 2002.

Toshiba Computer Systems Group: Pocket PC e570 <http://www.toshiba.com> Jul. 7, 2001.

Toshiba Computer Systems Group<http://www.toshiba.com> May 28, 2002.

* cited by examiner

METHOD AND APPARATUS TO IMPROVE TACTILE FEEL FOR KEYBOARDS AND BUTTON ASSEMBLIES

CROSS-REFERENCE TO RELATED APPLICATIONS

This application is a Continuation of U.S. patent application Ser. No. 10/772,110 filed on Feb. 3, 2004, now U.S. Pat. No. 7,164,088 entitled "Method and Apparatus to Improve Tactile Feel for Keyboards and Button Assemblies," which claims priority to U.S. Provisional Patent Application Ser. No. 60/455,178 filed on Mar. 16, 2003, entitled "Handheld PDA, Telephone, and Camera," and also to U.S. Provisional Patent Application 60/479,392 filed on Jun. 17, 2003, entitled "Communicator." Each of the above-referenced priority applications is hereby incorporated by reference in its respective entirety.

BACKGROUND OF THE INVENTION

1. Field of the Invention

This application pertains generally to keyboards for electronic devices and more specifically to keyboards for handheld electronic devices.

2. Description of Related Art

As electronic devices shrink, their keyboards are being designed to be correspondingly smaller in size. Smaller keyboards have keys physically closer to one another and have associated problems with tactile feel and key bounce. Conventional keyboards often use unitary keys and an associated actuator located under the keys. Smaller keyboards sometimes use other types of molded keys. If a small keyboard has molded keys spaced close together, the keys are often coupled to each other in some manner. Thus, pressing on one molded key pulls on its neighbors, adversely affecting the user's tactile feedback.

Moreover, use of smaller keys often leads to the use of smaller snap domes under the keys. These smaller domes have a lower snap ratio and therefore adversely affect the user's tactile experience.

What is needed is a keyboard that minimizes key bounce and improves the feel of the keyboard for the user. The actions of the keys should be decoupled from each other as much as possible. In addition, it is desirable that the keyboard be small but that the user still be able to type quickly and locate keys by touch.

BRIEF SUMMARY OF THE INVENTION

The above needs are met by a keyboard for an electronic device that incorporates a flexible carrier for the keys. The flexible carrier has cutouts or slots that aid in decoupling the actions of one key from its neighbors. Moreover, in addition to or instead of cutouts or slots, the flexible carrier optionally has cutouts around its outer perimeter to eliminate a "rib" around the periphery of the keyboard.

In some embodiments, the keys are molded as part of the flexible carrier. In other embodiments, the keys are attached to or inserted in the flexible carrier during manufacture.

Various embodiments of the invention employ various key shapes to aid the user's tactile experience while typing.

The figures depict embodiments of the present invention for purposes of illustration only. One skilled in the art will readily recognize from the following description tat alternative embodiments of the structures and methods illustrated herein may be employed without departing from the principles of the invention described herein.

DETAILED DESCRIPTION OF PREFERRED EMBODIMENTS

Figure 1A:
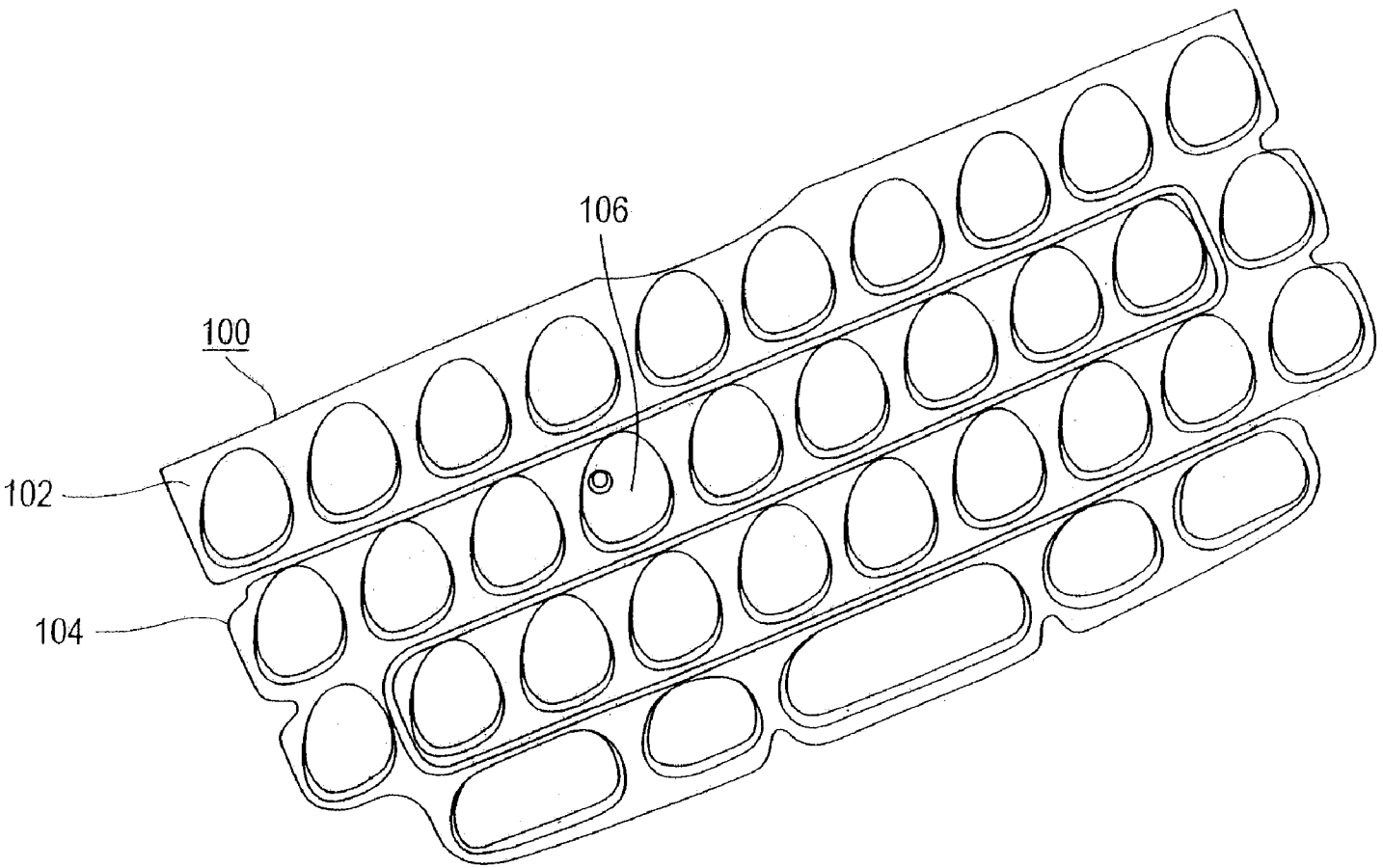
FIG. 1*a* shows an embodiment in which a flexible carrier is divided into two pieces.

FIG. 1*a* shows an embodiment of the present invention in which a flexible carrier 100 has serpentine openings between its keys that divides the flexible carrier into two pieces 102, 104. In the described embodiments, the flexible carrier is a silicone rubber carrier, although other appropriate materials can be used. In general, the carrier preferably is formed of a material that is at least somewhat tactilely absorbing. Placing one or more openings in flexible carrier 100 increases freedom of movement of the keys associated with the carrier.

Figure 1B:
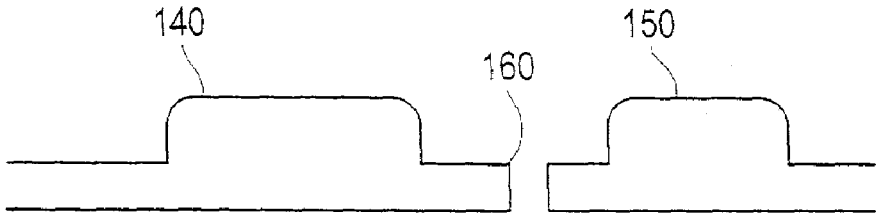
FIG. 1*b* shows an example of two keys decoupled from each other and in an un-pressed state.
Figure 1C:
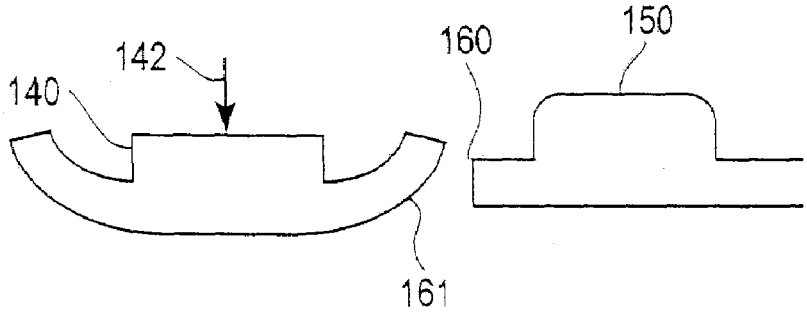
FIG. 1*c* shows an example of two keys decoupled from each other, where one is in a pressed state and one is in an un-pressed state

As an example of how openings in the flexible carrier serve to decouple key movement, FIG. 1*b* shows two keys 140, 150 in proximity on a flexible carrier having an opening 160. As can be seen in FIG. 1*c*, pressing downward 142 on first key 140 causes depression 161 of the flexible carrier on which the key is located. Because the flexible carrier flexes at the opening 160, the portion of the carrier supporting neighboring key 150 flexes less or not at all. The keys may be formed as an integral part of the carrier 100 or may be formed in other ways, some examples of which are shown in FIGS. 13*a*-13*e*. The invention is appropriate for any situation where pressing on a key causes flexing in a carrier of the key, adversely affecting its neighbor keys. In general, the width of the openings should be wide enough so that the edges of the flexible carrier do not hit each other when they flex. In general, the openings of the flexible carrier can be as wide as needed to support a desired key layout, although most layouts require a certain amount of surface area on the flexible carrier for it to do an adequate job of supporting the keys. In the described embodiment, support for the keys is afforded by top housing holes and flat combined with a flexible carrier and the actuators sitting on top of the snap domes. Other embodiments may afford key support through a subset of superset of this mechanism.

In FIG. 1*a*, the two pieces 102 and 104 are serpentine-shaped, in that they each form a general U-shape and nest inside each other. In the Figure, the two arms of piece 102 are of different lengths while the two arms of piece 104 are approximately the same length, although other configurations can be used without departing from he spirit of the invention. Other embodiments may use a flexible carrier having serpentine shapes that have more than one bend if, for example, the keypad contains a large number of keys. Similarly, other embodiments may use a flexible carrier divided into shapes having one bend (as shown) or no bends. Some embodiments may divide the flexible carrier using openings having a non-straight edge, such as a wavy or zig-zag edge.

In FIG. 1*a*, a key 106 fourth from the right in the second row contains an inverted dimple. This dimple differentiates key 106 from the other keys by touch and allows a user to find a key orientation by touch if the user knows which key contains the dimple. It should also be noted that flexible carrier 100 contains cutouts along its outer perimeter. These perimeter cutouts are not part of all embodiments. Such cutouts are discussed in more detail in connection with FIG. 6*a* below.

Figure 2:
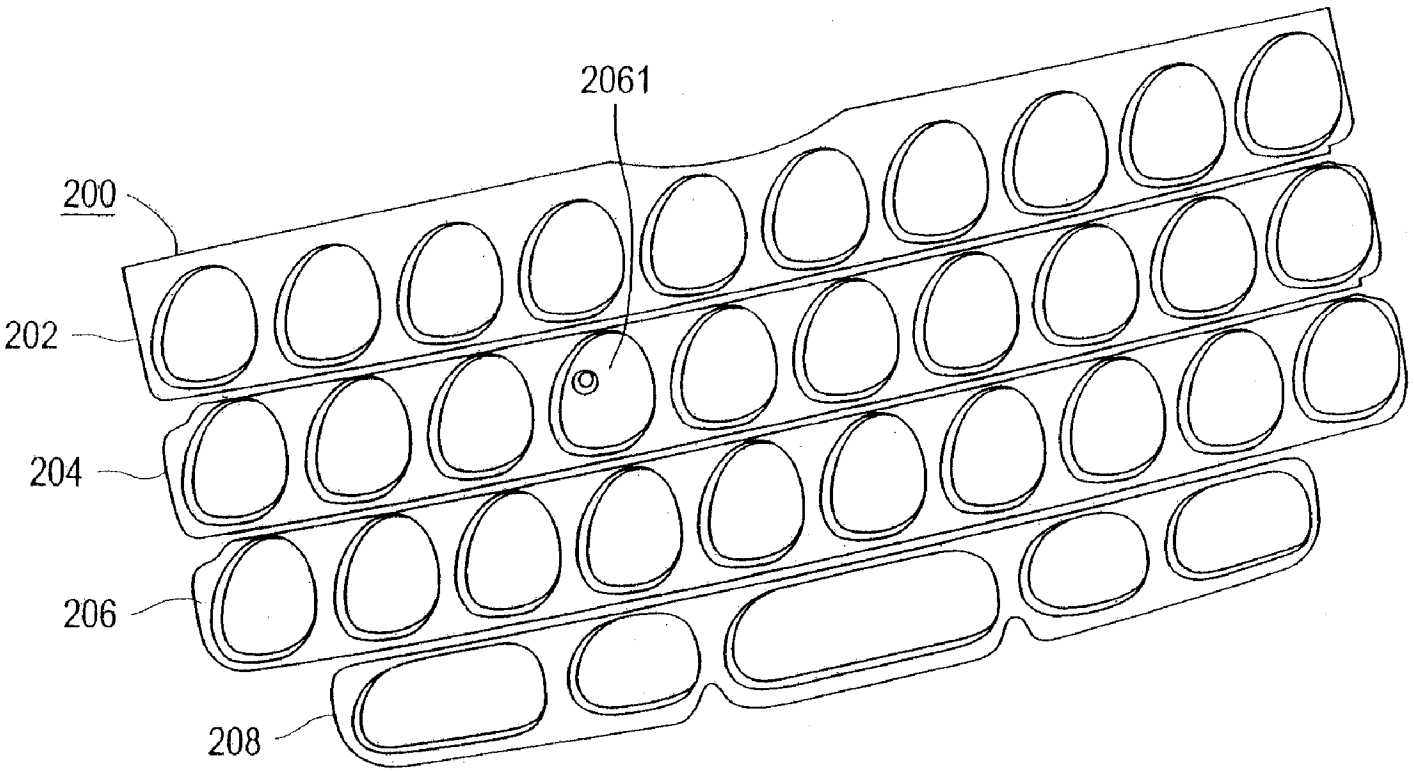
FIG. 2 shows an embodiment in which a flexible carrier is divided into four pieces.

FIG. 2 shows an embodiment in which a flexible carrier 200 has openings between keys that divides the flexible carrier into multiple pieces 202, 204, 206, 208. In the described embodiments, the flexible carrier is a silicone rubber carrier, although other appropriate materials can be used. Placing one or more openings in flexible carrier 200 increases freedom of movement of the keys associated with the carrier.

In FIG. 2, the pieces 202, 204, 206, 208 form rows. In other embodiments, the openings are placed so that the pieces form wider rows with more than one row of keys per row of the flexible carrier. In other embodiments, the openings are placed so that the pieces form columns. In some embodiments, each column has one vertical line of keys. The keys in such a column may be arranged in a straight line or staggered. Other embodiments have multiple vertical columns with more than one column of keys per column of the flexible carrier. Still other embodiments have openings in the flexible carrier dividing the carrier into both rows and columns, with one or more keys in each piece so formed.

In FIG. 2, a key 2061 fourth from the right in the second row from the top of the carrier contains an inverted dimple. This dimple differentiates key 2061 from the other keys by touch and allows a user to find a key orientation by touch if the user knows which key contains the dimple. It should also be noted that flexible carrier 200 contains cutouts along its outer perimeter. These perimeter cutouts are not part of all embodiments. Such cutouts are discussed in more detail in connection with FIG. 6*a* below.

Figure 3A:
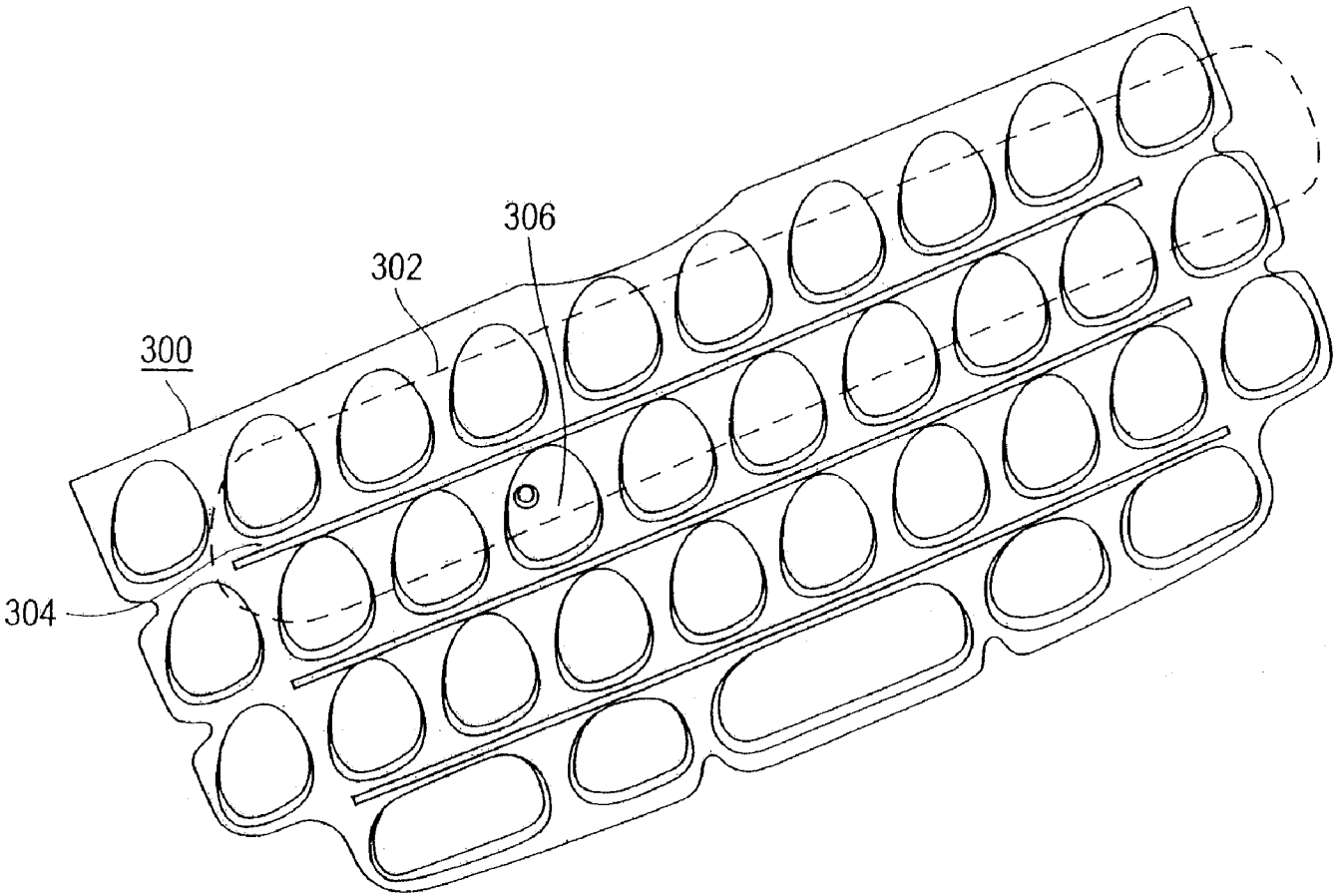
FIG. 3*a* shows an embodiment in which a flexible carrier has a plurality of slots.

FIG. 3*a* shows an embodiment in which a flexible carrier 300 has a plurality of openings or slots. These slots are similar to the openings of FIG. 2, but the openings in flexible carrier 300 do not extend through the perimeter of the carrier 300. As in FIG. 2, the openings or slots can be arranged into rows, columns, or a combination thereof. They also can be arranged in a serpentine manner similar to that shown in FIG. 1*a*.

In FIG. 3*a*, a key 306 fourth from the right in the second row from the top of the carrier contains an inverted dimple. This dimple differentiates key 306 from the other keys by touch and allows a user to find a key orientation by touch if the user knows which key contains the dimple. It should also be noted that flexible carrier 300 contains cutouts along its outer perimeter. These perimeter cutouts are not part of all embodiments. Such cutouts are discussed in more detail in connection with FIG. 6*a* below.

Figure 3B:
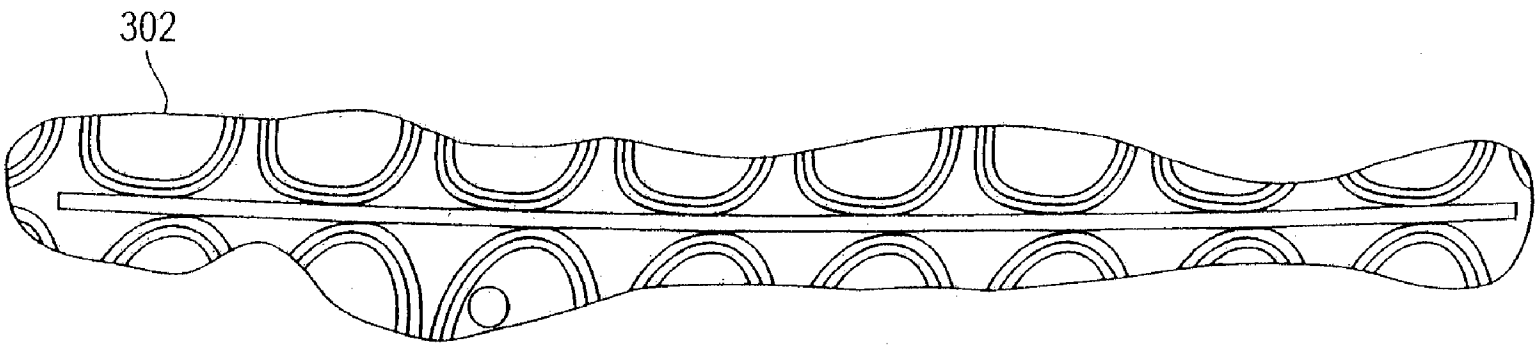
FIG. 3*b* shows details of a slot of FIG. 3*a*.

FIG. 3*b* shows details of a slot 302 of FIG. 3*a*. In the described embodiment, the slots are located between the keys, but do not touch the keys. This arrangement allows for increased stability of the carrier, because it has a flat area intact between the rows of keys.

Figure 4A:
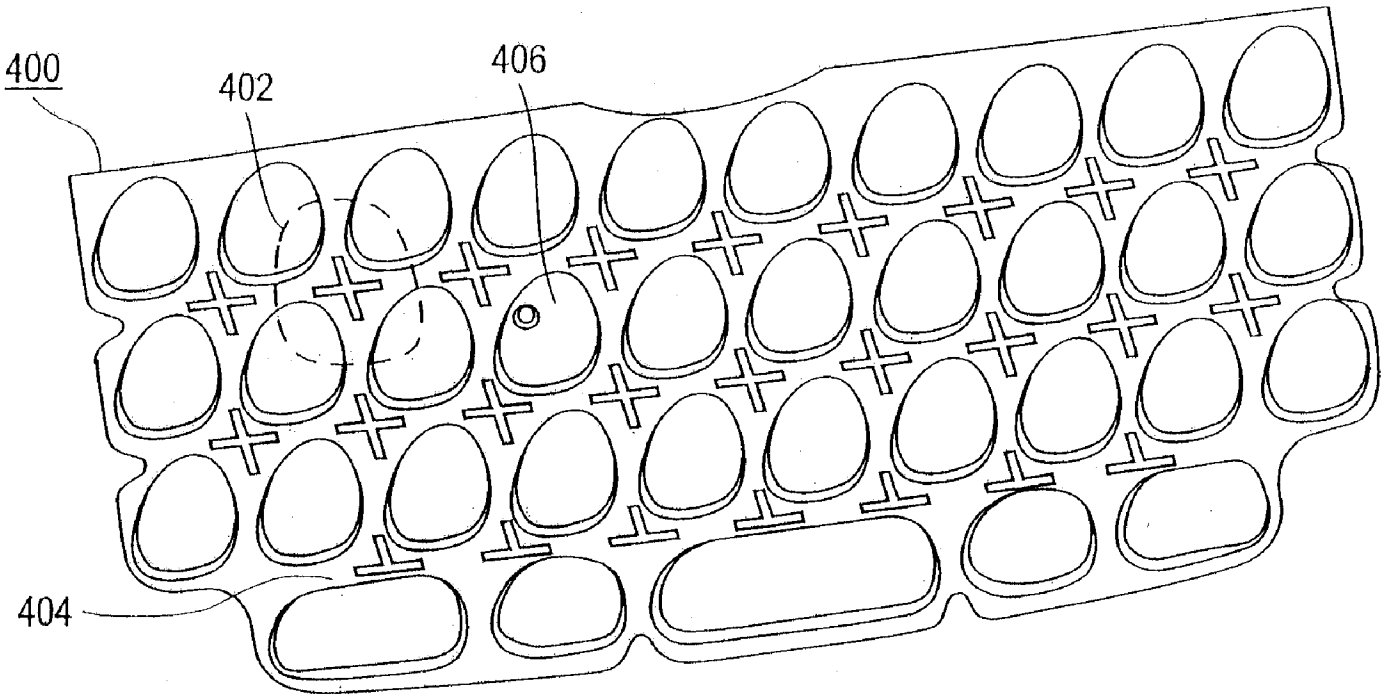
FIG. 4*a* shows an embodiment in which a flexible carrier has a plurality of cruciform-shaped openings.

FIG. 4*a* shows an embodiment in which a flexible carrier 400 has a plurality of cruciform-shaped openings 402. In other embodiments, only some of the cruciform openings shown in the figure are present. Even a reduced number of openings provides an advantage of decoupling key movement. The cruciform shape allows flexing of the carrier while retaining a large amount of carrier material, giving rise to a more rugged platform for the keys. Note that a bottom row of cruciform shapes have only a partial cruciform shape.

In FIG. 4*a*, a key 406 fourth from the night in the second row from the top of the carrier contains an inverted dimple. This dimple differentiates key 406 from the other keys by touch and allows a user to find a key orientation by touch if the user knows which key contains the dimple. It should also be noted that flexible carrier 400 contains cutouts along its outer perimeter. These perimeter cutouts are not part of all embodiments. Such cutouts are discussed in more detail in connection with FIG. 6*a* below.

Figure 4B:
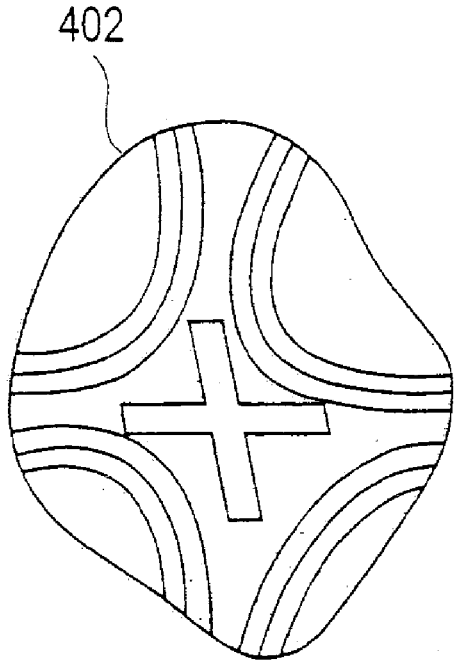
FIG. 4*b* shows details of a cruciform-shaped opening of FIG. 4*a*.

FIG. 4*b* shows details of a cruciform-shaped opening 402 of FIG. 4*a*. In the described embodiment, the openings are located between the keys, but do not touch the keys. This arrangement allows for stability of the carrier, because it has a flat area intact between each row of keys.

Figure 5A:
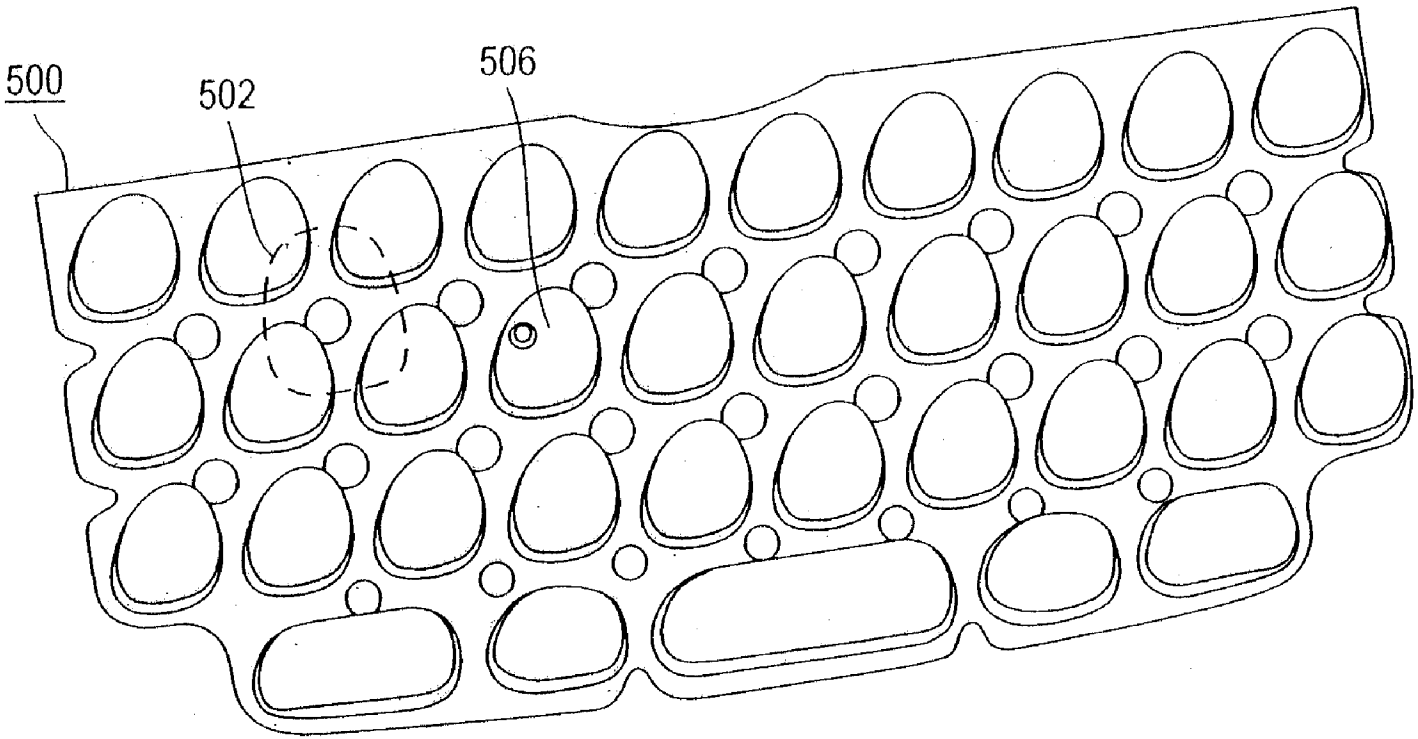
FIG. 5*a* shows an embodiment in which a flexible carrier has a plurality of round openings.

FIG. 5*a* shows an embodiment in which a flexible carrier 500 has a plurality of approximately round openings 502. In other embodiments, only some of the openings shown in the figure are present. Even a reduced number of openings provides an advantage of decoupling key movement. The round shape allows flexing of the carrier while retaining a large amount of carrier material, giving rise to a more rugged platform for the keys.

While approximately round openings are shown in the figure, other embodiments use oval openings, or other openings having a closed curve, such as hexagons, squares, free-form openings, and so on. Any openings that remove some or all excess carrier material from the flexible carrier are within the scope of the present invention. In some embodiments, at least two openings have different shapes. For example, the flexible carrier can be divided into wide rows and have round openings within the rows. As another example, the openings may be a combination of shapes, such as a combination of round and cruciform-shaped.

In FIG. 5*a*, a key 506 fourth from the right in the second row from the top of the carrier contains an inverted dimple. This dimple differentiates key 506 from the other keys by touch and allows a user to find a key orientation by touch if the user knows which key contains the dimple. It should also be noted that flexible carrier 500 contains cutouts along its outer perimeter. These perimeter cutouts are not part of all embodiments. Such cutouts are discussed in more detail in connection with FIG. 6*a* below.

Figure 5B:
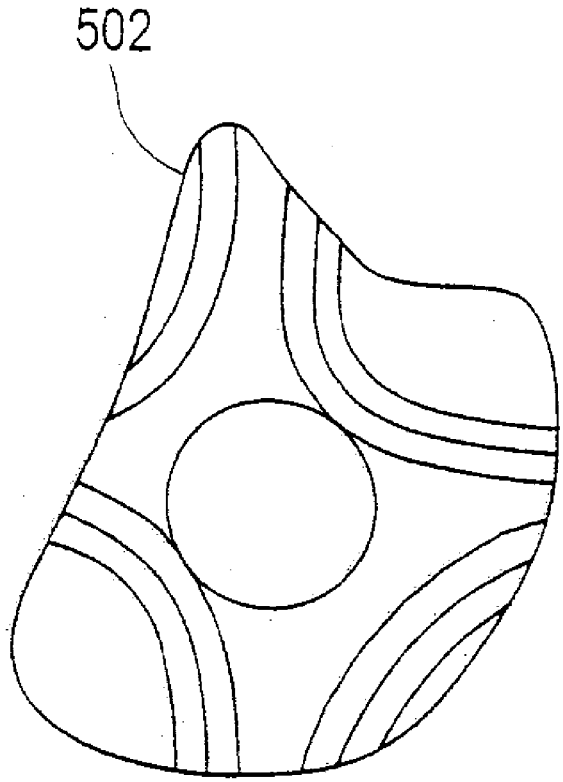
FIG. 5*b* shows details of a round opening of FIG. 5*a*.

FIG. 5*b* shows details of a round opening 502 of FIG. 5*a*. In the described embodiment, the openings are located between the keys, but do not touch the keys. This arrangement allows for stability of the carrier, because it has a flat area intact between each row of keys. In general, for all cutout shapes discussed herein some or all of the cutouts or holes can touch the keys as long as there is sufficient carrier material remaining to locate and simplify the manufacture process.

Figure 6A:
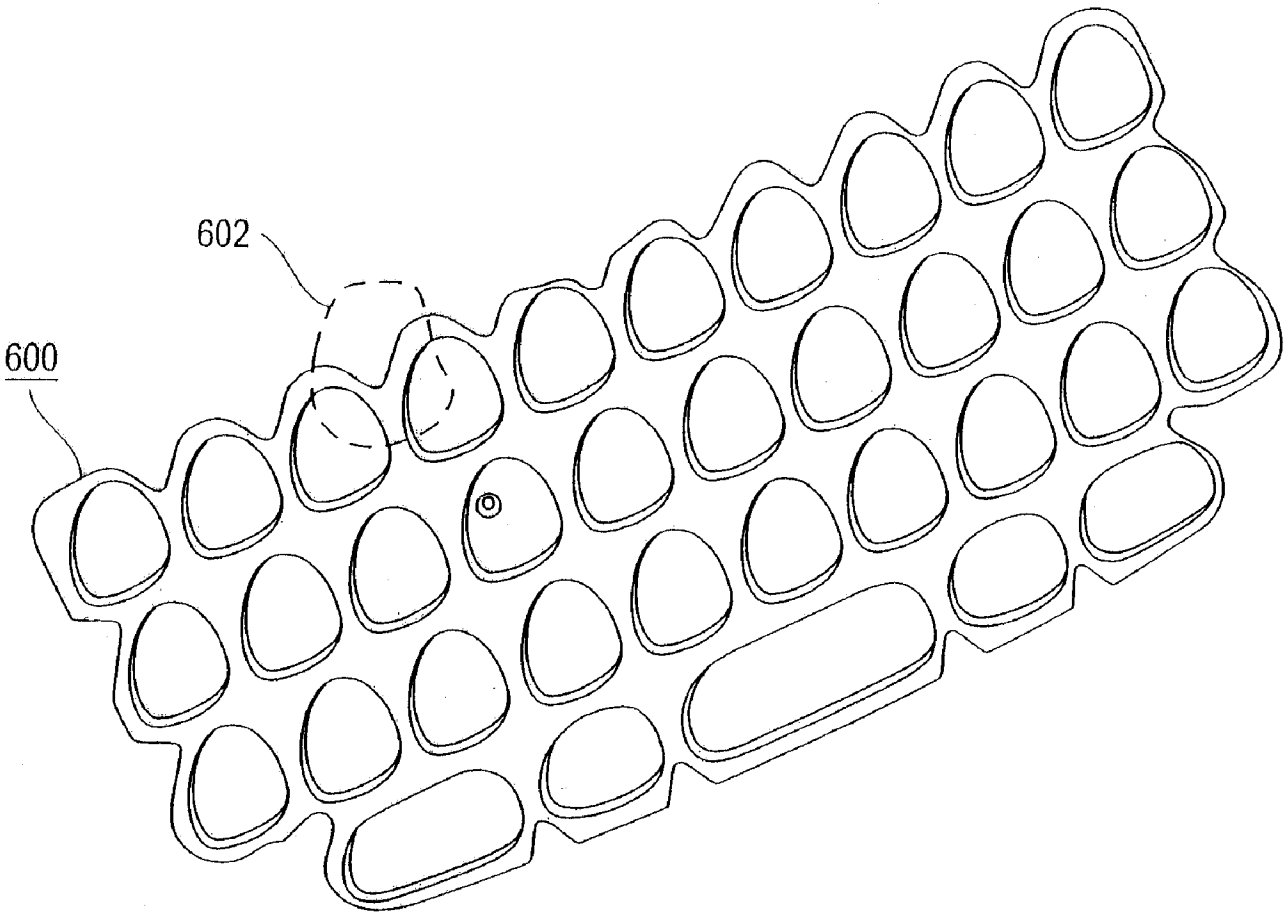
FIG. 6*a* show an embodiment in which a flexible carrier has cutouts around its outer perimeter.

FIG. 6*a* show an embodiment in which a flexible carrier 600 has cutouts around its outer perimeter. These perimeter cutouts, also called edge detailing, improve the usability of the perimeter keys since it eliminates the "rib" that would otherwise surround the outer perimeter of the carrier. When present, a rib binds the keys somewhat and inhibits flexing of the carrier at its perimeter. Note that, in this embodiment, the keys themselves are not symmetrical. Thus, the perimeter cutouts tend also not to be symmetrical, although they could be symmetrical or non-symmetrical without departing from the spirit of the invention. As shown in the various embodiments above, a carrier having perimeter cutouts can also have additional openings therein.

Figure 6B:
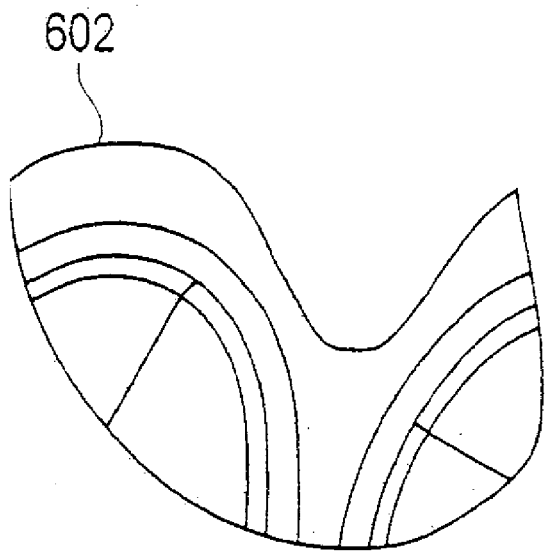
FIG. 6*b* shows details of the perimeter cutouts of FIG. 6*a*.

FIG. 6*b* shows details of the perimeter cutouts 602 of FIG. 6*a*. In the described embodiments, the cutouts do not touch the keys, although they do so in other embodiments.

FIGS. 7-12 show example of various key tops that can be used with the present invention to enhance a user's typing experience. It will be understood that the shapes described herein are not exhaustive of all possible shapes and are offered here for the sake of example. While the examples shown use poly carbonate keycaps covering a flexible silicone rubber carrier, it will be understood that the key shapes shown can be used with a variety of appropriate materials. In the described embodiments, key shape is one way that certain keys are tactilely differentiated from other keys. For example, numeric keys may have peaks, dimples, domes, bowls, etc as discussed below in more detail.

It will be understood that the principle of forming openings in a flexible carrier can also be applied for key shapes other than those discussed above. For example, certain communicators and personal digital assistants such as the palmOne Treo 600 use a five-way rocker switch 1003 (show, for example, in FIG. 10). Such a five-way switch also has a flexible carrier underneath. In some embodiments, the flexible carrier has openings of a nature similar to those discussed above. The flexible carrier can be separate from a flexible carrier corresponding to the main keyboard or can be part of a unitary carrier supporting the main keyboard and other keys or buttons. Such a unitary keyboard optionally has openings between the five-way switch and the main keyboard. Furthermore, flexible carrier openings in accordance with the invention can be used in conjunction with a QWERTY keyboard having a flexible carrier beneath.

Figure 7:
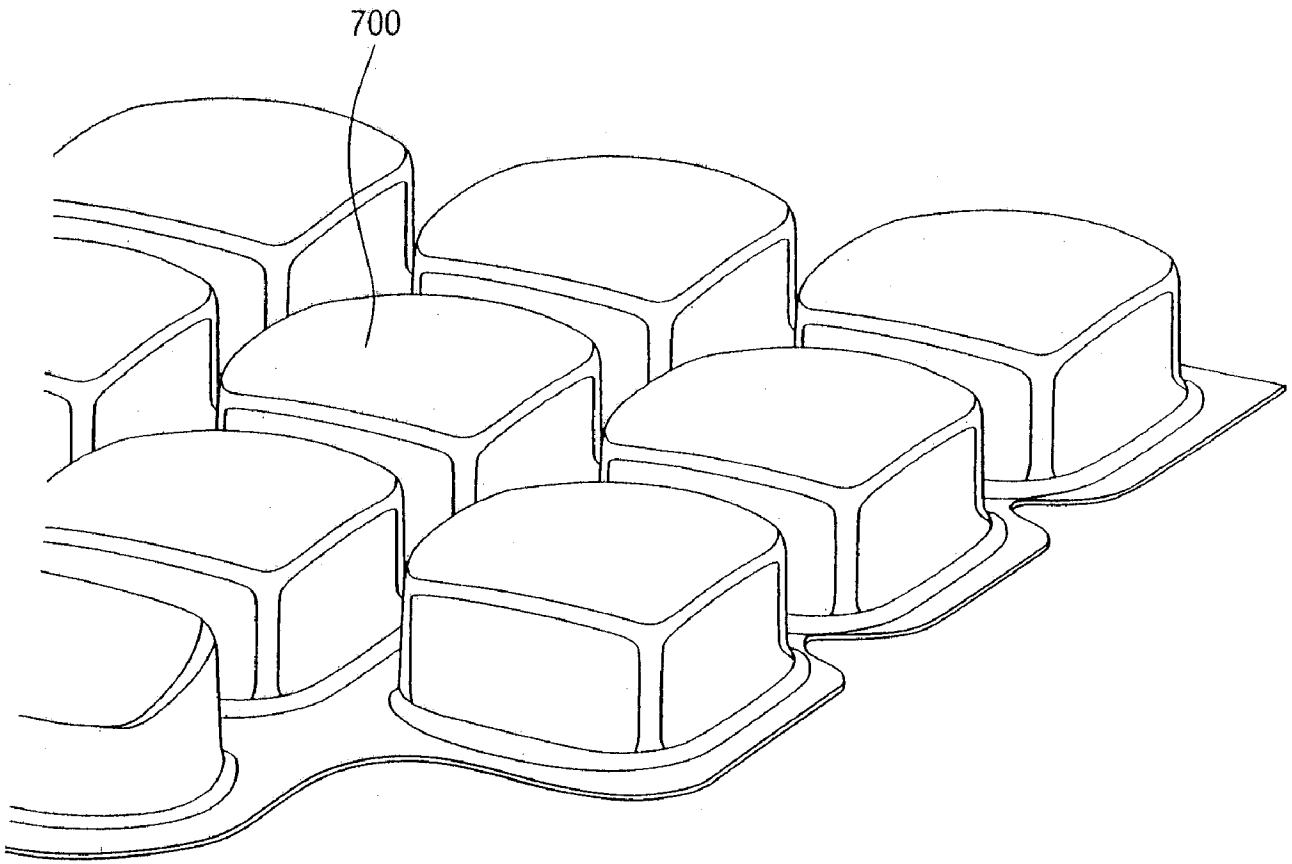
FIG. 7 shows an example of a flexible carrier having domed keys.

FIG. 7 shows an example of a flexible carrier having domed keys 700.

Figure 8:
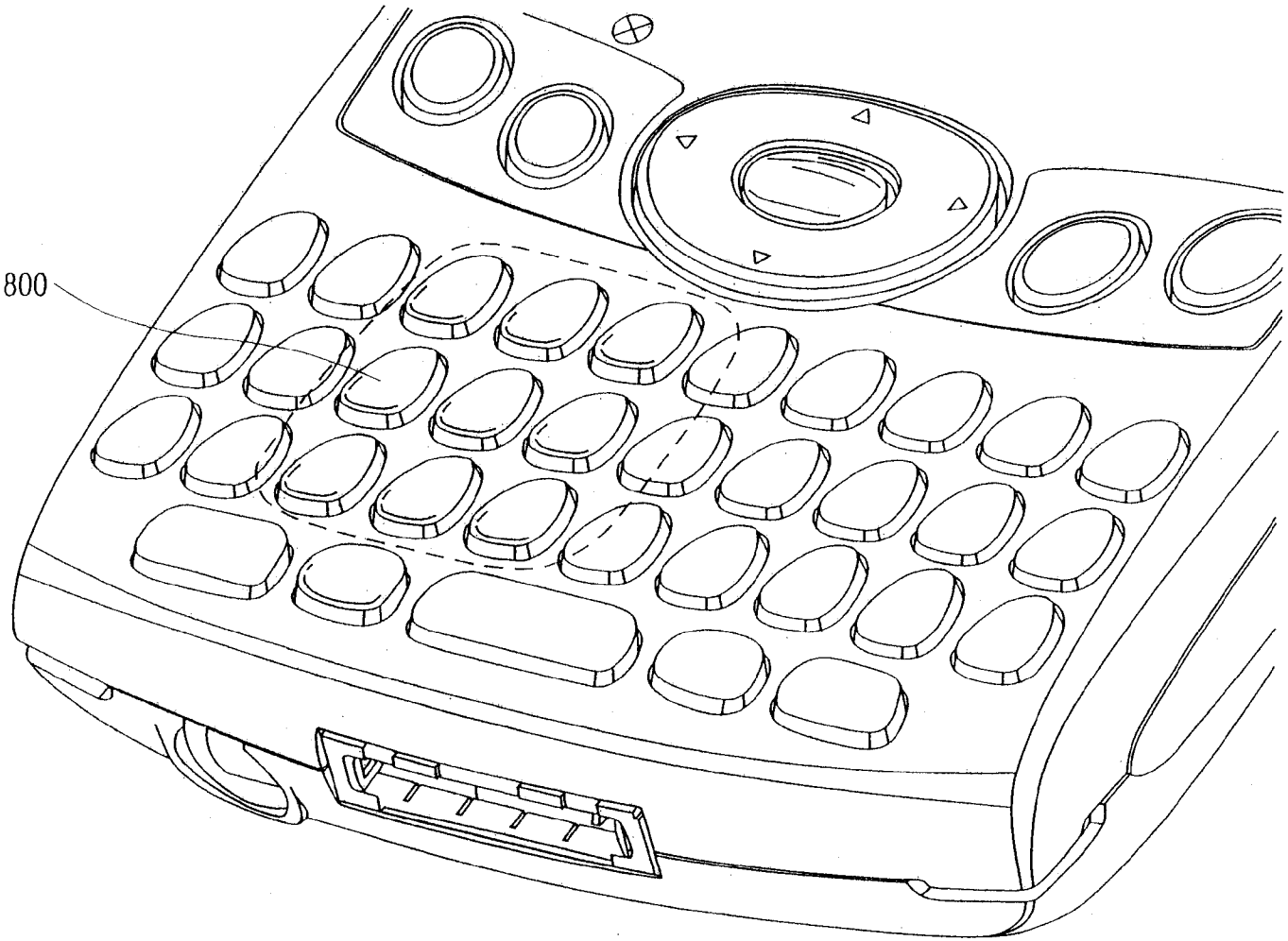
FIG. 8 shows an example of a flexible carrier having bowl-shaped keys.
Figure 9:
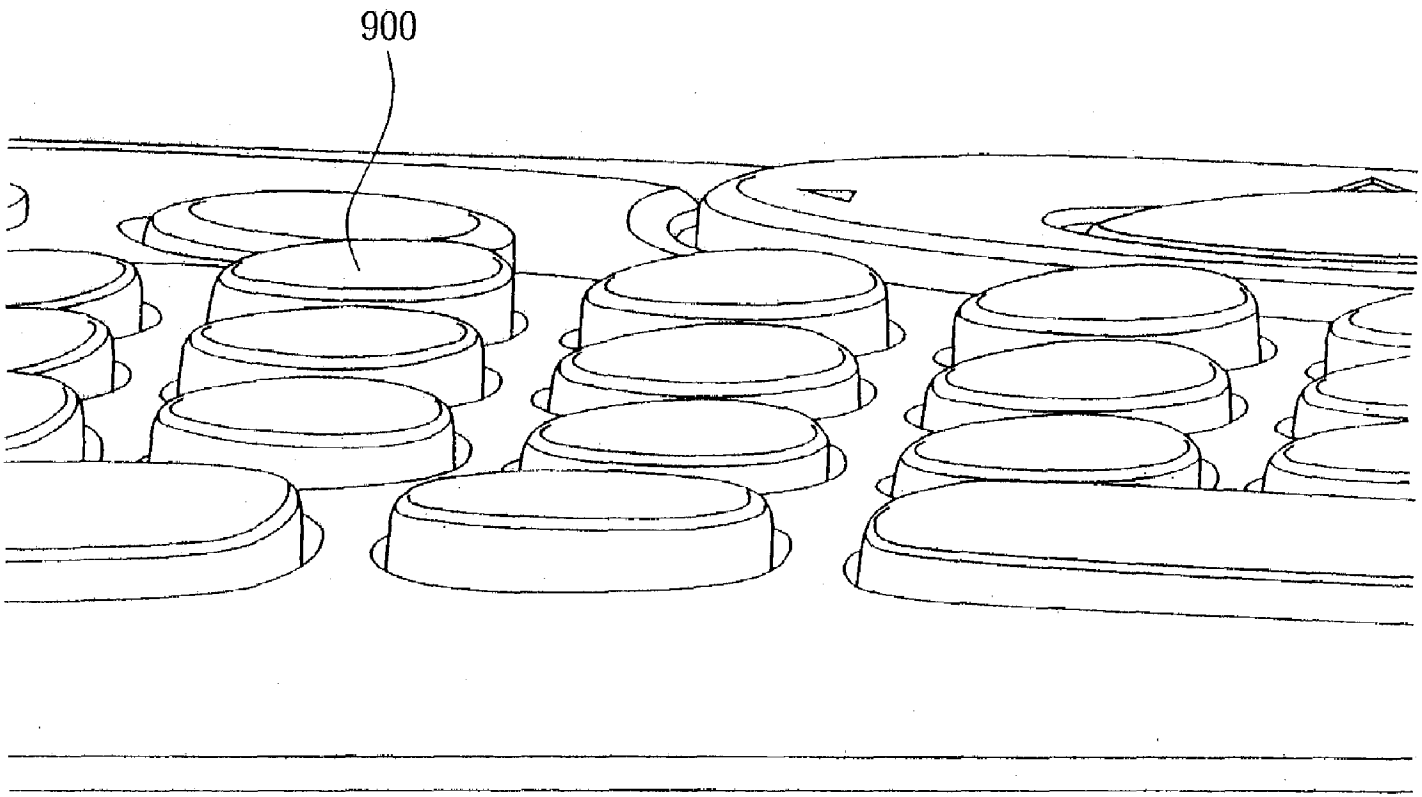
FIG. 9 shows a detailed example of the bowl-shaped keys of FIG. 8.

FIG. 8 shows an example of a flexible carrier having bowl-shaped keys 800. Here, the bowl-shaped keys are used only on keys that contain numeric symbols, allowing a user to tactilely differentiate the numeric keys. In this example, additional keys are the top of the keypad are also differentiated by a bowl shape. FIG. 9 shows an example 900 of details of the bowl-shaped keys of FIG. 8.

Figure 10:
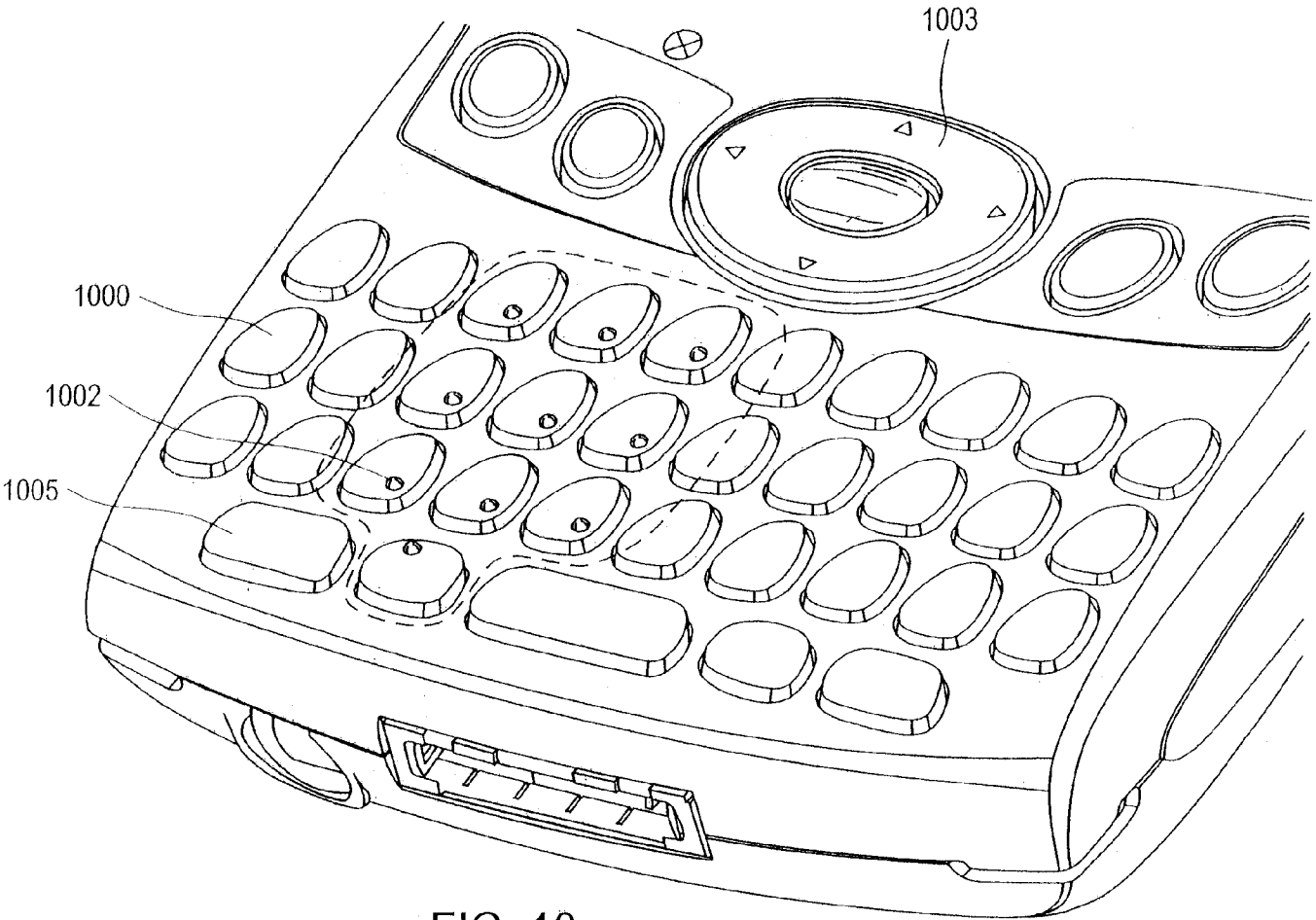
FIG. 10 shows an example of a flexible carrier having selected keys with inverted dimples.

FIG. 10 shows an example of a flexible carrier having selected keys 1002 with inverted dimples. In this example, the inverted dimples are placed on keys having numerals therein (not shown). Thus, the first row of keys having inverted dimples corresponds to "123." The second row of keys corresponds to "456". The third row of keys correspond to "789" and the bottom key corresponds to "0". For example, if the small electronic device is in an "alt" mode, pressing key 1002 will cause the device to act as if the user had pressed a "7" key. Inverted dimples on the numeric keys aid the user in finding these keys by touch, thus speeding up both touch-typing and hunt and peck typing. FIG. 1*a*, for example, shows an inverted dimple on only a single centrally located key 106 (corresponding to "5"). It will be understood that other embodiments may use inverted dimples to call attention to other keys instead of numeric keys or to keys in addition to numeric keys.

Figure 11:
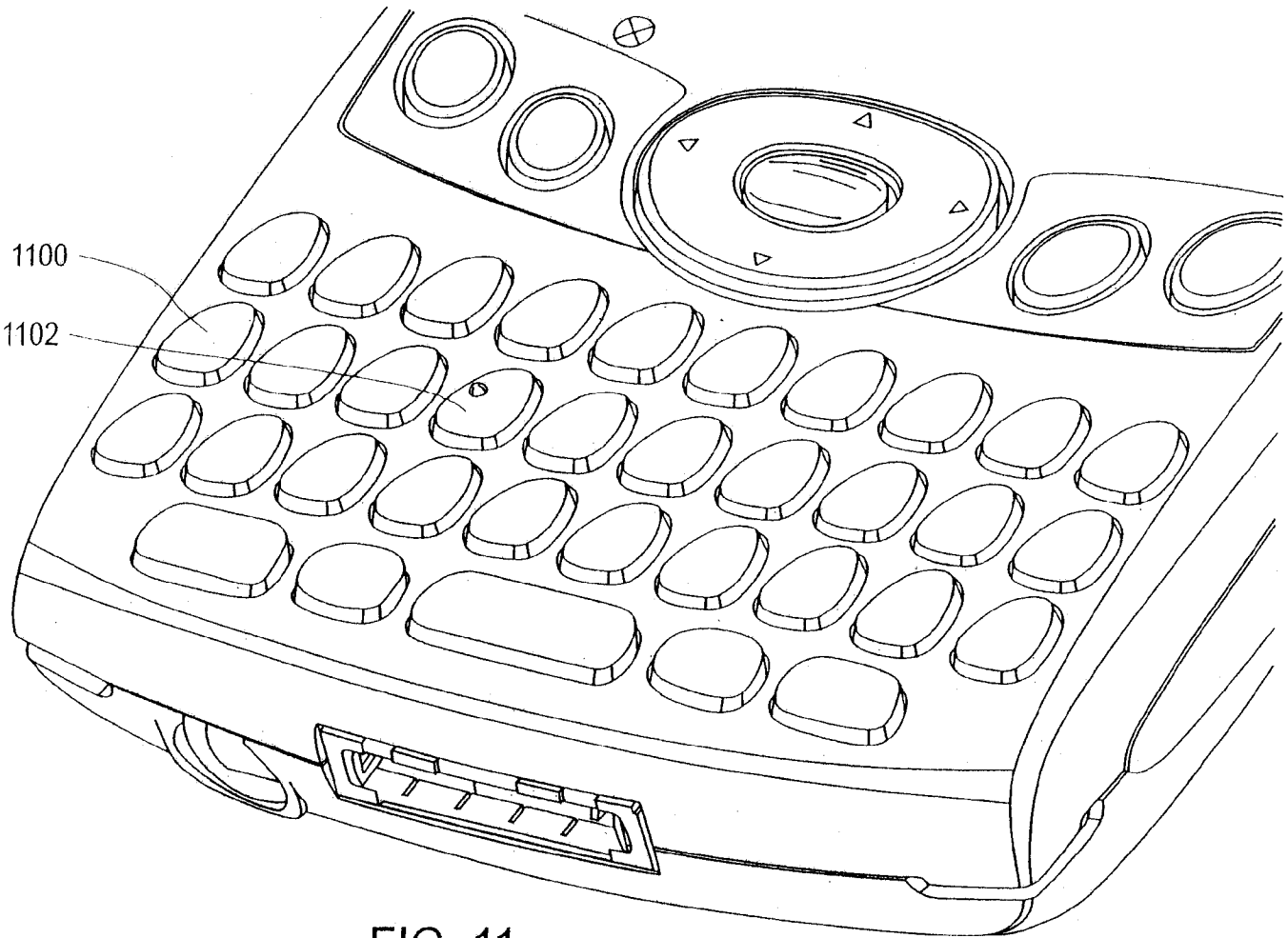
FIG. 11 shows an example of a flexible carrier having keys with a very slight dome.

FIG. 11 shows an example of a flexible carrier having keys with a very slight dome, one of the keys having a differentiating dimple.

Figure 12:
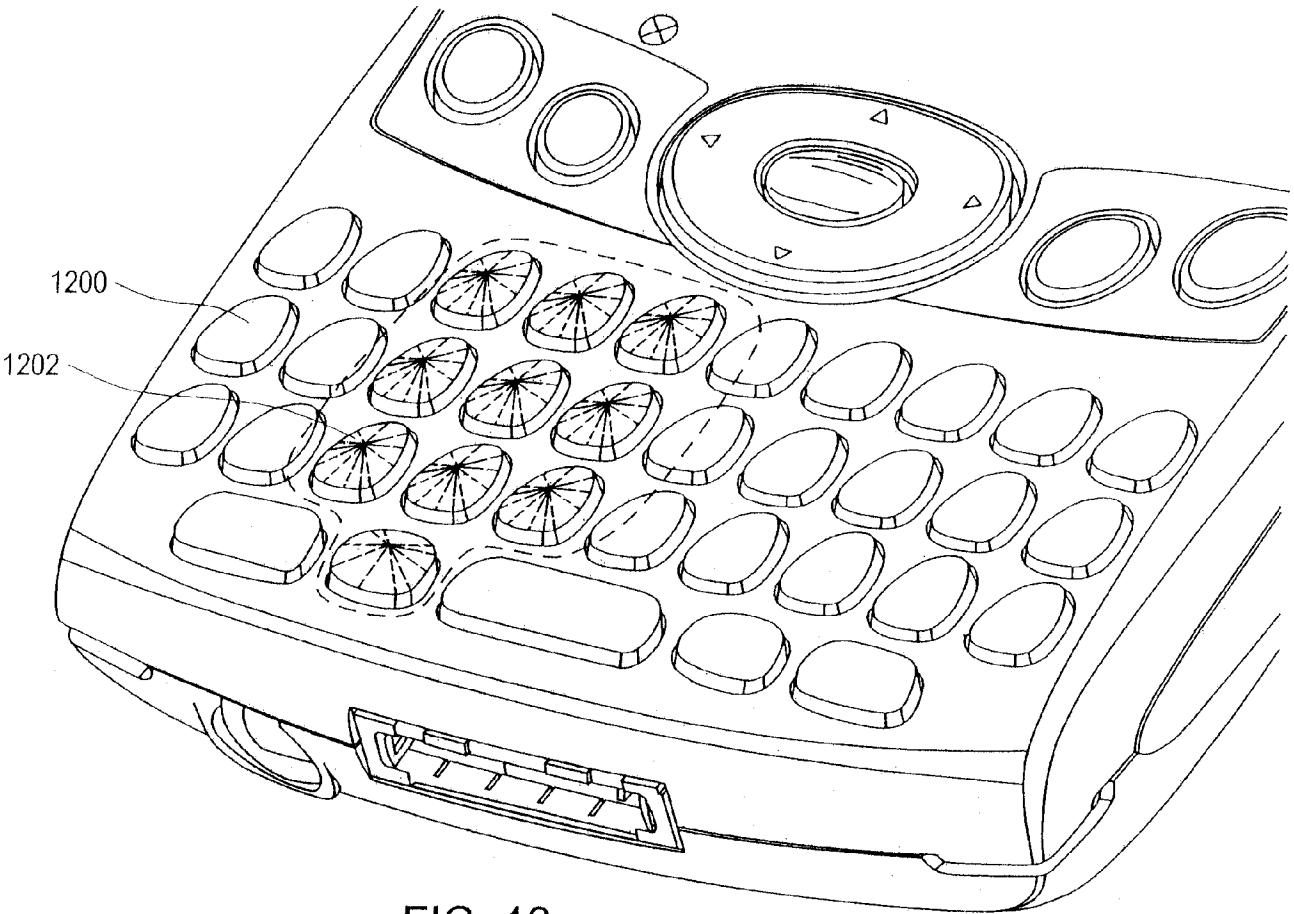
FIG. 12 shows an example of a flexible carrier having selected keys with peaks.

FIG. 12 shows an example 1200 of a flexible carrier having selected keys with peaks 1202. Here, the peaked keys correspond to numeric keys, similar to the manner discussed above in connection with FIG. 10. With peaked keys, the entire key is convex, coming to a dull point in the center.

FIGS. 13*a*-13*e* show some examples of keys that can be used in connection with a flexible carrier in the present invention.

Figure 13A:
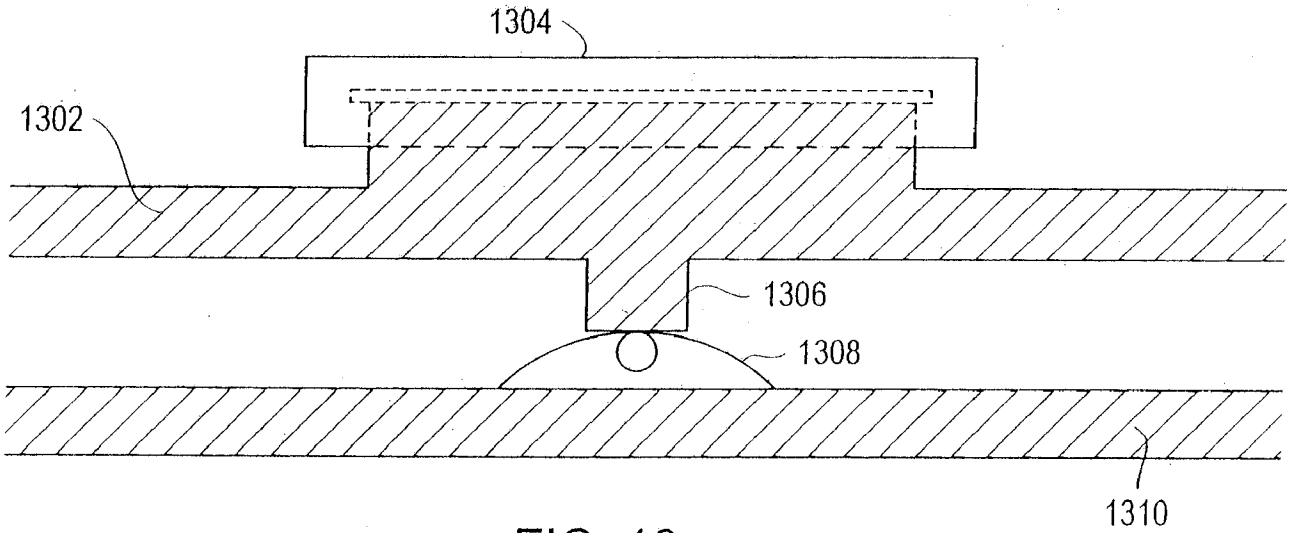
FIG. 13*a* shows an example of a flexible carrier with a separate overlapping keycap thereon.

FIG. 13*a* shows an example of a flexible carrier 1302 with a separate overlapping keycap thereon. In one embodiment, the flexible carrier is formed of silicone rubber. In another embodiment, the flexible carrier is formed of polycarbonate, but the flexible carrier can be formed of any appropriate flexible material that enables key presses to be distinguished. Flexible carrier 1302 has a series of raised keys formed thereon. Use of a single carrier makes the feel of the keys less mushy since it provides a semi-rigid surface to support the keys when they are being pressed.

At least one of the keys is covered with a molded key top 1304. Here, the molded key top 1304 does not extend downward to contact the horizontal surface of the flexible carrier 1302, although it may do so in other embodiments. In one embodiment, the key top is formed of a thermoplastic amorphous resin. Other embodiments use crystalline thermoplastic resin or a thermoset resin. While key top 1304 is shown with 90 degree edges and a flat top surface, it will be understood that the key top shown is shown for the purpose of example, and other embodiment may use keys with other corner shapes, such as rounded or beveled, and may use concave or convex tops, examples of which are shown in FIGS. 7-12 above. It will be understood that the relative size and scale of the elements shown in this document is for purposes of example only and should not be taken in a limiting sense.

A portion of the flexible carrier 1306 contacts a snap dome 1308. When the key top is pressed, the flexible carrier flexes sufficiently to allow a portion 1306 of the flexible carrier to depress snap dome 1308. Snap dome 1308 connects with an appropriate location 1324 on printed circuit board 1310 to register a key press.

Figure 13B:
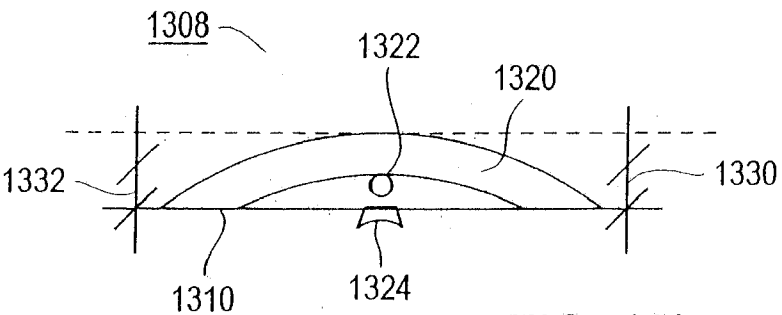
FIG. 13*b* shows a detail of a snap dome of FIG. 13*a*.

FIG. 13*b* shows a detail of a snap dome of FIG. 13*a*. When a dome 1320 is depressed, a connection area 1324 makes contact with a conductive pad 1322 under the snap dome to register a key press. One embodiment uses 4 millimeter snap domes for the main keys and uses five millimeter snap domes for several larger keys (such as keys 1005 of FIG. 10), although other sizes could be used without departing from the spirit of the invention. The invention can be used with both smaller and larger scale keys, buttons, keypads, and keyboards. Numeral 1330 shows a height of the snap dome when it is not depressed. Numeral 1332 shows a height of the snap dome when it is depressed.

Figure 13C:
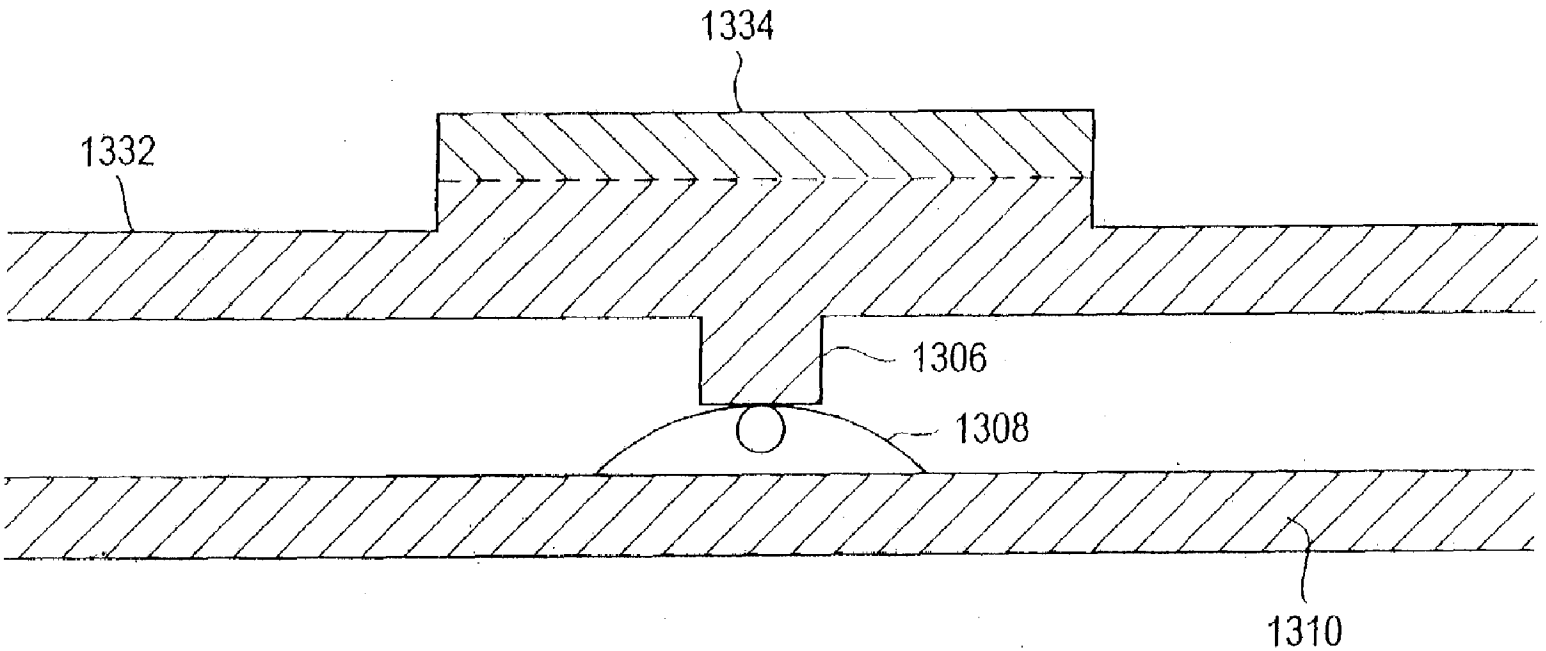
FIG. 13*c* shows an example of a flexible carrier with a separate non-overlapping keycap thereon.

FIG. 13*c* shows an example of a flexible carrier 1332 with a separate non-overlapping keycap 1334 thereon. In this example, the key top 1334 does not extend over the sides of the key portion of the flexible carrier.

Figure 13D:
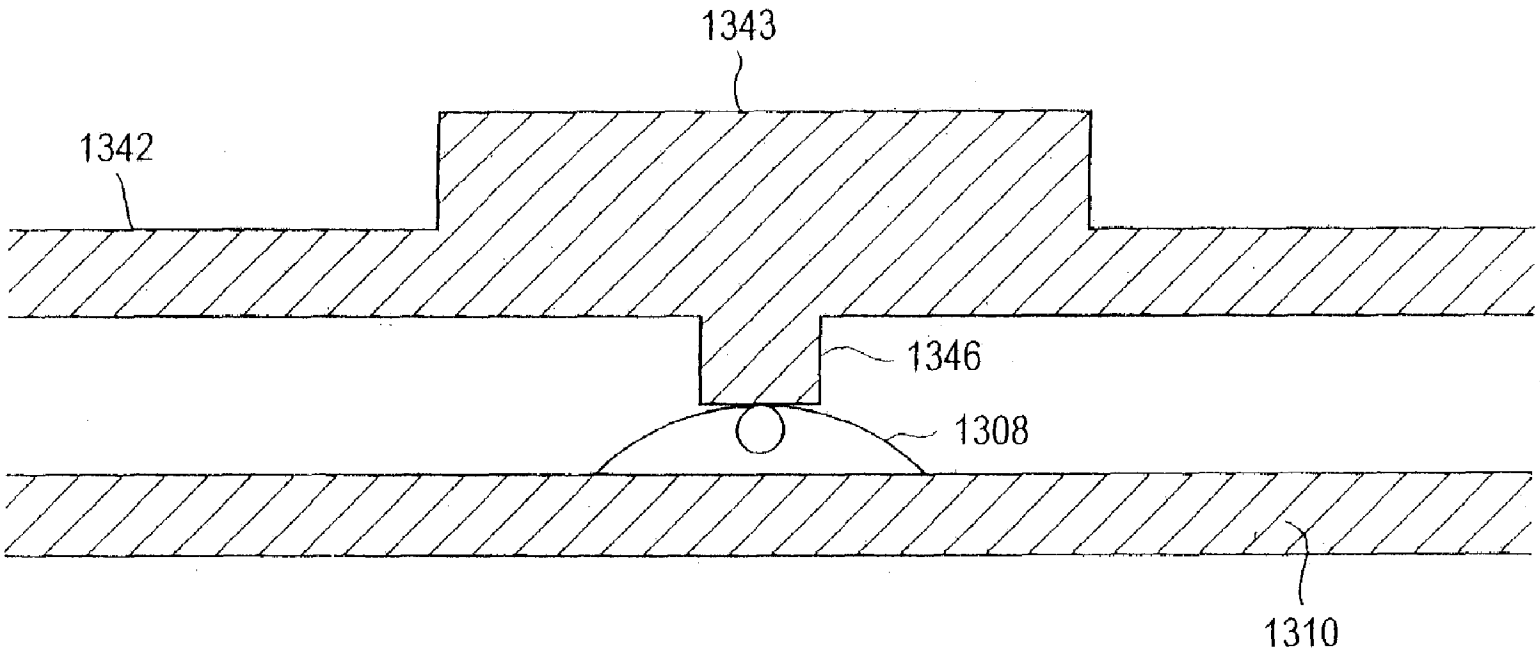
FIG. 13*d* shows an example of a flexible carrier with a unitary key.

FIG. 13*d* shows an example of a flexible carrier 1342 with a unitary key. No separate key top material is added to a raised key area 1343.

Figure 13E:
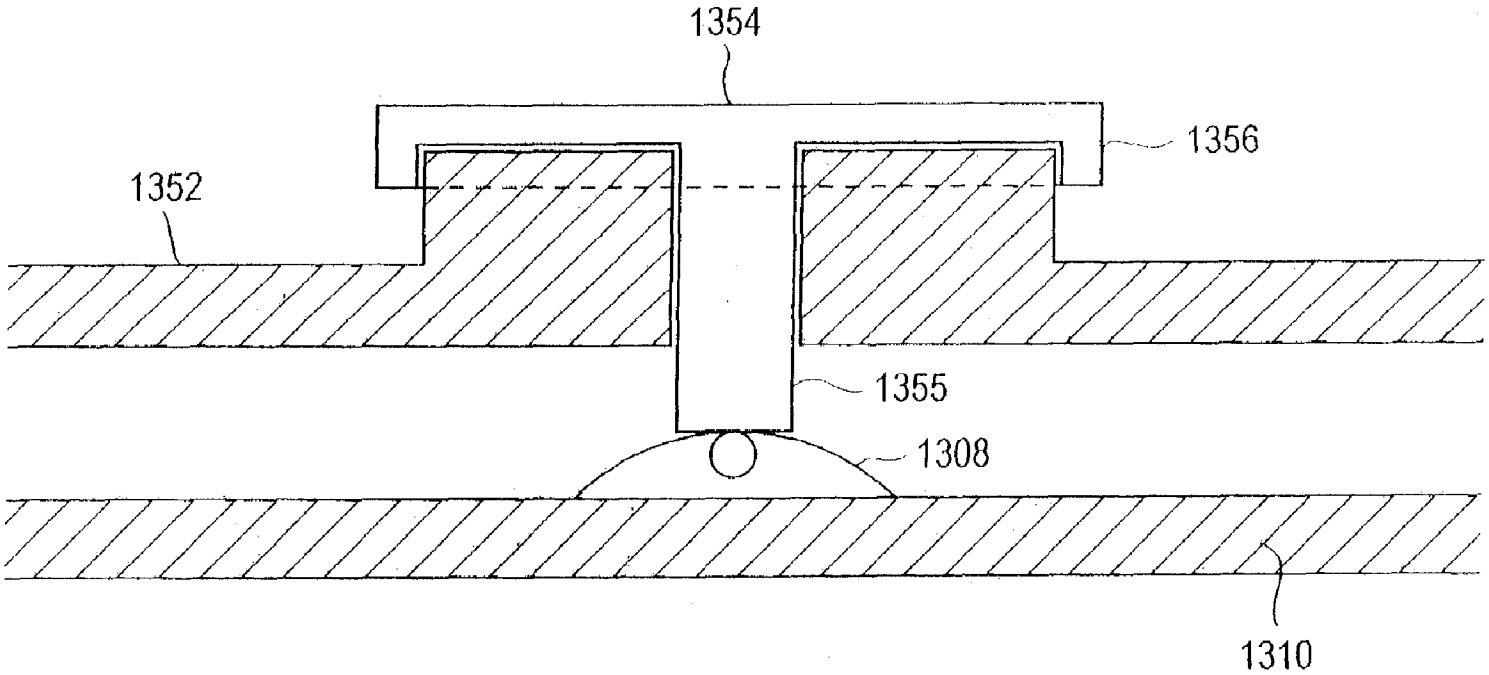
FIG. 13*e* shows an example of a flexible carrier with an actuator key inserted therethrough.

FIG. 13*e* shows an example of a flexible carrier 1352 with an actuator key 1354 inserted therethrough. In this example, the flexible carrier is insertion molded during manufacture and separately formed actuators or keys are inserted therein. In the example, the actuator has a lip 1356 extending downward. Other embodiments do not include this lip.

The above description is included to illustrate the operation of the preferred embodiments and is not meant to limit the scope of the invention. The scope of the invention is to be limited only by the following claims. From the above discussion, many variations will be apparent to one skilled in the relevant art that would yet be encompassed by the spirit and scope of the invention.

We claim:

1. A keypad, comprising:

a plurality of keycaps; and a flexible carrier on which the plurality of keycaps are provided, wherein the flexible carrier interconnects at least some of the plurality of keycaps to one another;

wherein the flexible carrier has (i) one or more flat regions that extend between one or more of the keycaps, and (ii) a plurality of formations for which material of the carrier is removed or reduced as compared to the one or more flat regions; and wherein the flexible carrier is separate from a circuit layer that is provided underneath the flexible carrier, the circuit layer including electrical contacts for enabling use of the keypad.

2. The keypad of claim 1, wherein the one or more formations include one or more slots formed on a surface of the flexible carrier.

3. The keypad of claim 1, wherein the plurality of keycaps are formed as a unitary part of the flexible carrier.

4. The keypad of claim 1, wherein the plurality of keycaps are attached to the flexible carrier.

5. The keypad of claim 1, wherein the one or more formations include multiple slots that combine to form a cruciform shape.

6. The keypad of claim 1, wherein at least one of the one or more formations are round openings.

7. The keypad of claim 1, wherein at least two of the plurality of formations are shaped differently.

8. The keypad of claim 1, wherein one or more of the plurality of formations include an opening that divides the flexible carrier into multiple parts.

9. The keypad of claim 8, wherein the multiple parts correspond to multiple columns.

10. The keypad of claim 8, wherein the multiple parts correspond to multiple rows.

11. The keypad of claim 8, wherein the multiple parts include a zig-zag shaped edge.

12. The keypad of claim 1, wherein one or more of the plurality of formations divide the flexible carrier into at least two serpentine-shaped parts.

13. The keypad of claim 1, wherein the plurality of formations include at least one slot formed in the flexible carrier.

14. The keypad of claim 1, wherein the flexible carrier includes one or more cutouts in an outer perimeter of the flexible carrier.

15. The keypad of claim 14, wherein at least one of the one or more cutouts in the outer perimeter occur in accordance with locations of the plurality of keycaps.

16. The keypad of claim 1, wherein the one or more openings serve to decouple the plurality of keycaps from each other.

17. The keypad of claim 1, wherein at least one of the plurality of keycaps is tactilely differentiated from others of the keycaps.

18. The keypad of claim 1, wherein at least one of the plurality of keycaps are domed.

19. The keypad of claim 1, wherein the plurality of formations include one or more openings.

20. The keypad of claim 19, wherein at least one of the openings are oval shaped.

21. The keypad of claim 19, wherein the one or more openings in the flexible carrier occur in accordance with locations of the plurality of keycaps.

22. The keypad of claim 1, wherein the plurality of formations include one or more ribs.

23. The keypad of claim 1, wherein the plurality of formations include one or more formations that (i) are provided between at least two adjacent keycaps and (ii) hinder movement of one of the at least two adjacent keycaps as a result of an other of the at least two adjacent keycaps being pressed inward by a user.

24. The keypad of claim 1, wherein the flexible carrier is formed from silicon rubber.

* * * * *